US005376510A

United States Patent [19]

Parker et al.

[11] Patent Number: 5,376,510

[45] Date of Patent: Dec. 27, 1994

[54] CONCENTRATED PHOTOGRAPHIC DEVELOPING SOLUTION

[75] Inventors: Michael J. Parker, Cheshire; Anthony M. Lannon, Stockport; Terence C. Webb; William E. Long, both of Cheshire, all of United Kingdom

[73] Assignee: Ilford Limited, Cheshire, England

[21] Appl. No.: 166,621

[22] Filed: Dec. 13, 1993

[30] Foreign Application Priority Data

Dec. 19, 1992 [GB] United Kingdom ..... 9226488

[51] Int. Cl.[5] ..... G03C 5/30

[52] U.S. Cl. ..... 430/466; 430/440; 430/464; 430/480; 430/483; 430/486; 430/491; 430/492

[58] Field of Search ..... 430/440, 441, 464, 465, 430/466, 480, 483, 485, 491, 492

[56] References Cited

U.S. PATENT DOCUMENTS

| | | | |
|---|---|---|---|
| 3,938,997 | 2/1976 | Firch et al. | 430/466 |
| 4,987,060 | 1/1991 | Marchesano | 430/434 |
| 5,098,819 | 3/1992 | Knapp | 430/436 |
| 5,196,298 | 3/1993 | Meeus et al. | 430/483 |
| 5,236,816 | 8/1993 | Purol et al. | 430/492 |

FOREIGN PATENT DOCUMENTS 9311456 10/1993 WIPO .

*Primary Examiner*—Hoa Van Le

*Attorney, Agent, or Firm*—Darby & Darby

[57] ABSTRACT

There is described a concentrated photographic silver halide developing solution which comprises from 50 to 150 g/liter of an ascorbic acid type compound of the general formula I:

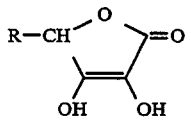

I or alkali metal salts thereof, in which the group R represents a hydroxylated alkyl group, and at least one basic compound the anion of which is carbonate, sulphite or hydroxide of which the cation is an alkali metal, especially sodium or potassium, the total sodium to total potassium ion ratio in the concentrated developing solution being from about 50:50 to 0:100 (mole: mole).

Preferably the concentrated solution is entirely aqueous but it may comprise a proportion of water-miscible organic solvents such as ethyl alcohol, or glycol solvents.

10 Claims, No Drawings

CONCENTRATED PHOTOGRAPHIC DEVELOPING SOLUTION

FIELD OF THE INVENTION

This invention relates to liquid concentrates of photographic silver halide developing solutions.

BACKGROUND OF THE INVENTION

Suitable compositions and components for photographic developing solutions are well known, and are described for example, in the books Photographic Processing Chemistry by LFA Mason, published by the Focal Press in 1975, any Modern Photographic Processing by G M Haist, published Wiley-Interscience in 1979.

Of recent years, there has been increasing interest in the use of ascorbic acid and related compounds as the agents in photographic silver halide developing solutions. The use of ascorbic acid and related compounds as developing agents is well known, but the recent increase in interest in these developing agents has been prompted by health and safety concerns about other silver halide developing agents.

The use of concentrated photographic developer solutions is also well known. A formulation of a concentrated hydroquinone developer which can be diluted 1:9 before use is given in Haist's book, vol 1, p 528. There is a need, however, for concentrated developers using ascorbic acid as developing agent.

By a concentrated photographic developer we mean a liquid concentrate which has to be diluted with water or other diluent before use, by addition of at least about five parts of water to one part of concentrate (1:5), and preferably by addition of at least about nine or ten parts of water to one part of concentrate. Liquid concentrates are simpler and quicker to dilute than powder formulations, and the greater the dilution factor the less water needs to be transported.

To date, however, a method has not been found for incorporating ascorbic acid or related compounds in concentrated developer compositions. For instance the formulations described in U.S. Pat. No. 5,098,819 are prepared at the final concentration, and not diluted at all.

SUMMARY OF THE INVENTION

We have discovered a concentrated ascorbate based developing solution which is stable as the concentrated solution and which when diluted acts as an efficient silver halide developing solution.

Therefore according to the present invention there is provided a concentrated photographic silver halide developing solution which comprises from 50 to 150 g/liter of at least one ascorbic acid type compound of the general formula I:

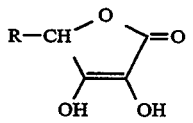

I or alkali metal salts thereof, in which the group R represents a hydroxylated $C_1$–$C_4$ alkyl group, and at least one basic compound the anion of which is carbonate, sulphite or hydroxide of which the cation is an alkali metal, especially sodium or potassium, the total sodium/potassium ion ratio in the concentrated developing solution being from about 50:50 to 0:100 (mole:mole).

DESCRIPTION OF THE PREFERRED EMBODIMENTS

Preferably the concentrated solution is entirely aqueous but it may comprise a proportion of water-miscible organic solvents such as ethyl alcohol, or glycol solvents.

Preferred compounds of formula I for use in the present invention include L-ascorbic acid, D-isoascorbic acid and L-erythroascorbic acid. Salts of such compounds may also be used. Preferably the sodium salts of the compound of formula I are used, and are commercially available in solid form. In general, synthesis of the Formula I compounds is well within the skill in the art.

A preferred ion ratio of sodium to potassium in the concentrated developing solution is from 20:80 to 10:90.

It is preferred to include both sulphite and carbonate and both as the potassium salts, the sulphite serving not only as a basic compound but also as an anti-oxidant and as a development accelerator (noted in U.S. Pat. No. 5,098,819 which is incorporated by reference entirely) and the carbonate serving as a basic compound and as a buffer in the diluted solution when in use. Sufficient sulphite and carbonate should be present so that when the concentrate is diluted to a working strength developer, the pH is within the range of 9.0 to 11.0.

When the concentrated developing solution of the present invention is to be diluted 1:9 the amount of the compound of formula I present in the concentrate is from 60 to 110 g/liter (weighed as the sodium salt). A suitable amount of sulphite in the concentrate as potassium sulphite is from 100 to 200 g/liter. If the diluted concentrated solution has too high a pH, then a quantity of potassium metabisulphite can be added to the concentrated solution to decrease the pH. Alternatively, the pH may be adjusted by use of the free ascorbic acid compound, or by the use of the free acid of a metal complexing agent (described below), or by the use of alkali metal bicarbonate. A suitable amount of alkali metal carbonate is up to 300 g/liter, preferably between 100 and 300 g/liter, depending on the quantity of alkali metal sulphite and the desired final pH.

A suitable amount of carbonate as potassium carbonate is from 150 to 220 g/liter.

In order to achieve maximum efficiency when using the concentrated developing solution of the present invention at working strength it is preferred to carry out development of exposed silver halide material using the diluted developing solution of the present invention in the presence of an electron transfer agent.

Most preferably the electron transfer agent is present in the concentrated developing solution of the present invention. However, it may be present in an auxiliary developing solution which is used in conjunction with the concentrated developing solution of the present invention or it may be present in the silver halide material which is to be developed.

By electron transfer agent is meant a compound which acts synergistically with a main developing agent such as ascorbic acid or hydroquinone to provide an active relatively long lasting developing combination. A large number are known from the patent literature but in practice the two most commonly used ones are amino-phenols such as p-methylaminophenol which is known commercially as Metol and pyrazolidinone compounds of general formula II

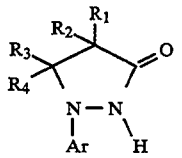

II in which Ar is an aromatic ring, $R_1$ and $R_2$ are hydrogen, lower alkyl, or hydroxy alkyl, and $R_3$ and $R_4$ are hydrogen, lower alkyl or phenyl. By lower alkyl is meant an alkyl group with up to 3 carbon atoms. Synthesis of these compounds is well within the skill in the art.

Preferably Ar is phenyl or a substituted phenyl such as 4-methyl phenyl or 4-chloro-phenyl.

A particularly preferred compound for use in the concentrated developing solution of the present invention is 1-phenyl -4-methyl-4-hydroxymethyl pyrazolid-3-one which is hereinafter referred to as compound A.

A suitable amount of compound A to be present in a concentrated developing solution of the present invention when it is to be diluted 1:9 is from 2 to 8 g/liter.

Preferably at least one metal complexing agent is present in the concentrated developing solution. A particularly suitable compound is diethylenetriamine pentacetic acid (DTPA).

Other suitable metal complexing agents include without limitation phosphonic acids such as 1-hydroxyethylidene 1,1-diphosphonic acid, diethylenetriamine penta(methylenephosphonic acid) ethylene diamine tetra(methylene phosphonic acid) and nitrilo tris (methylenephosphonic acid), and alkali metal salts thereof.

A suitable quantity of metal complexing agent to be present in the concentrated developing solution is up to 100 millimoles/liter.

An alkali bromide and in particular potassium bromide may be present in the developing solution as a stabilizer or antifoggant. A suitable amount is from 1–20 g/liter.

An organic antifoggant may be present in the developing solution. A suitable amount is from 0.1 to 0.5 g/liter. A preferred antifoggant is a benzotriazole.

It is not necessary to use organic cosolvents. However, it may be advantageous to use a quantity of organic cosolvent in the concentrate (e.g. up to 100 ml/L), either to aid dissolution of the pyrazolidinone (if used), or for a photographic effect. Suitable organic cosolvents include ethylene glycol and condensates, propylene glycol and condensates, and alkanolamines, for example N-methyl ethanolamine.

The liquid concentrate developers of the present invention are easily prepared and are stable. They are resistant to formation of precipitates on cooling. However, if the molar ratio of total (i.e. from all sources) sodium ions to total potassium ions exceeds about 50:50 then a concentrated solution cannot be prepared. Thus such compositions are not within the present invention.

The following Examples will serve to illustrate the invention without limiting its scope. The disclosure of patents and other documents cited herein is incorporated by reference.

EXAMPLE I

A liquid concentrate (developer 1) was prepared by adding the following components

| | |
|---|---|
| water | 670 ml |
| potassium sulphite 65% w/v solution | 150 ml |
| DTPA pentasodium salt 37% w/v solution | 68 ml |
| potassium carbonate | 200 g |
| sodium ascorbate | 100 g |
| compound A | 5 g |
| potassium bromide | 10 g |
| acetic acid 80% w/w solution | 17 ml |
| Benzotriazole | 0.2 g |
| pH - 10.50 | |
| % Na: K = 15:85 | |

In a photographic test one part of this developer concentrate was diluted with 9 parts of water and the resultant developer was used to process silver chlorobromide photographic paper. Comparison was made with a hydroquinone based developer (developer 2) in which the following components were present:

| | |
|---|---|
| water | 875 $cm^3$ |
| DTPA pentasodium salt 37% w/v solution | 35 $cm^3$ |
| sodium sulphite | 120 g |
| potassium carbonate | 150 g |
| hydroquinone | 35 g |
| compound A | 2.5 g |
| potassium bromide | 7 g |
| benzotriazole | 0.3 g |
| sodium hydroxide 67% w/v solution | 12 $cm^3$ |
| pH (1 + 9) = 10.80 | |

Both developers were tested by processing 75 (10″×8″) sheets of exposed silver chlorobromide paper in the fresh developer solution and in the same solution after letting it stand in an open dish for 18 hours (used developer).

| Dmin | Dmax | R4 | Developer | Comment |
|---|---|---|---|---|
| 0.00 | 2.13 | 0.14 | 1 | Fresh |
| 0.00 | 2.10 | 0.16 | 1 | Used developer |
| 0.00 | 2.11 | 0.14 | 2 | Fresh |
| 0.00 | 1.93 | 0.21 | 2 | Used developer |

Dmin and Dmax represent the minimum density (fog) and the maximum density of the paper and R4 is shoulder contrast, obtained by measuring the Δ log E between 80% Dmax and 95% Dmax. It can be seen that the developer 1 of the present invention gives superior results to that of the hydroquinone based developer (developer 2). When both developers have been used (exhausted) the diminution of the shoulder contrast is less and the Dmax drop is less when developer 1 is used compared with developer 2.

EXAMPLE 2

The developer of Example I was prepared with the same quantity of sodium erythorbate in place of sodium ascorbate. The following results were obtained for exposed silver chlorobromide paper which was processed in fresh working strength developer and in developer which had $5m^2$ of silver chlorobromide paper processed therein (used developer).

| Dmin | Dmax | R4 | Comment |
|---|---|---|---|
| 0.00 | 2.13 | 0.14 | Fresh |
| 0.00 | 2.12 | 0.13 | Used developer |

Dmin, Dmax and R4 are defined as in Example 1.

This shows that this developer, like the ascorbate based developer of Example 1 is an active developer which was still active after $5m^2$ of exposed silver chlorobromide paper had been processed therein.

What is claimed is:

1. A concentrated photographic silver halide developing solution which yields a working strength developing solution having a pH between 9 and 11 upon dilution 1:9 with water and comprises: (i) from 60 to 110 g/liter of at least one ascorbic acid type compound of the general formula I:

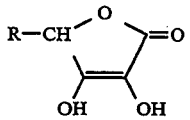

I or alkali metal salts thereof in which the group R represents a hydroxylated alkyl group, (ii) an electron transfer agent that acts as a synergistic developing agent, (iii) from 100 to 200 g/liter of potassium sulphite, (iv) from 150–220 g/liter of potassium carbonate, and (v) a molar ratio of total sodium ion to total potassium ion from about 20:80 to 0:100.

2. A concentrated silver halide developing agent according to claim 1 wherein the ascorbic acid type compound is L-ascorbic acid, D-isoascorbic acid, or L-erythroascorbic acid or alkali metal salts thereof.

3. A concentrated silver halide developing solution according to claim 1 wherein the ratio of total sodium to total potassium ions is 20:80.

4. A concentrated silver halide developing solution according to claim 1 wherein the ratio of total sodium to total potassium ions is 10:90.

5. A concentrated silver halide developing solution according to claim 1 wherein the electron transfer agent is an amino-phenol compound.

6. A concentrated silver halide developing agent according to claim 5 wherein the amino-phenol compound is p-methylamino-phenol.

7. A concentrated silver halide developing agent according to claim 1 wherein the electron transfer agent is a pyrazolidinone compound of the general formula II:

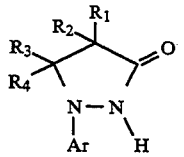

II in which Ar is an aromatic ring, $R^1$ and $R^2$ are hydrogen, lower alkyl, or hydroxy alkyl, and $R^3$ and $R^4$ are hydrogen, lower alkyl or phenyl. By lower alkyl is meant an alkyl group with up to 3 carbon atoms.

8. A concentrated developing solution according to claim 7 wherein the pyrazolidinone compound is 1-phenyl-4-methyl -4-hydroxymethyl pyrazolid-3-one.

9. A concentrated developing solution according to claim 1 which comprises as a metal complexing agent diethylenetriamine pentaacetic acid and alkali metal salts thereof.

10. A concentrated developing solution according to claim 1 which comprises as a metal complexing agent a phosphonic acid selected from 1-hydroxyethylidene 1, 1-diphosphonic acid, diethylenetriamine penta (methylenephosphonic acid), ethylene diamine tetra (methylene phosphonic acid) and nitrilotris (methylenephosphonic acid) and alkali metal salts thereof.

* * * * *